US011428109B2

(12) United States Patent
Martet et al.

(10) Patent No.: US 11,428,109 B2
(45) Date of Patent: Aug. 30, 2022

(54) TURBINE BLADE

(71) Applicant: SAFRAN AIRCRAFT ENGINES, Paris (FR)

(72) Inventors: Renaud James Martet, Moissy-Cramayel (FR); Thomas Langevin, Moissy-Cramayel (FR); Cyril Verbrugge, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 49 days.

(21) Appl. No.: 17/262,615

(22) PCT Filed: Jul. 23, 2019

(86) PCT No.: PCT/FR2019/051823
§ 371 (c)(1),
(2) Date: Jan. 22, 2021

(87) PCT Pub. No.: WO2020/021192
PCT Pub. Date: Jan. 30, 2020

(65) Prior Publication Data

US 2021/0262358 A1 Aug. 26, 2021

(30) Foreign Application Priority Data

Jul. 24, 2018 (FR) ..... 1856854

(51) Int. Cl.
*F01D 5/14* (2006.01)
*F01D 11/08* (2006.01)

(52) U.S. Cl.
CPC ..... *F01D 11/08* (2013.01); *F01D 5/14* (2013.01); *F05D 2240/30* (2013.01); *F05D 2240/55* (2013.01); *F05D 2250/712* (2013.01)

(58) Field of Classification Search
CPC . F01D 5/14; F01D 5/225; F01D 11/08; F05D 2240/30; F05D 2240/55; F05D 2250/712; Y02T 50/60
See application file for complete search history.

(56) References Cited

U.S. PATENT DOCUMENTS 9,963,980 B2 5/2018 Negri et al.
10,196,907 B2 2/2019 Bensalah et al.
(Continued)

FOREIGN PATENT DOCUMENTS

EP 2439376 A1 4/2012
FR 2970999 A1 8/2012
(Continued)

OTHER PUBLICATIONS

International Search Report dated Dec. 19, 2019, issued in corresponding International Application No. PCT/FR2019/051823, filed Jul. 23, 2019, 7 pages.
(Continued)

*Primary Examiner* — Igor Kershteyn
(74) *Attorney, Agent, or Firm* — Christensen O'Connor Johnson Kindness PLLC

(57) ABSTRACT

A turbine blade for a turbomachine includes a turbine blade with a leading edge and a trailing edge. The blade includes a radially outer platform with at least one lip extending radially towards the outside. The radially outer end of the leading edge and/or of the trailing edge of the turbine blade airfoil extending axially upstream and/or downstream, respectively, in relation to the platform. The blade has at least one partition extending radially towards the outside from the radially outer end of the turbine blade airfoil and axially between the leading edge and the upstream end of the platform and/or between the trailing edge and the downstream end of the platform.

11 Claims, 2 Drawing Sheets

(56) References Cited

U.S. PATENT DOCUMENTS

| | | | | |
|---|---|---|---|---|
| 2012/0195766 | A1 | 8/2012 | Cohin et al. | |
| 2015/0023793 | A1* | 1/2015 | Bensalah | F01D 5/30 416/193 A |
| 2015/0226070 | A1* | 8/2015 | Plante | F01D 5/225 416/212 A |
| 2015/0369058 | A1* | 12/2015 | Negri | F01D 5/288 29/889.71 |
| 2018/0371927 | A1* | 12/2018 | Kuwamura | F16J 15/4472 |

FOREIGN PATENT DOCUMENTS

| | | | |
|---|---|---|---|
| FR | 2985759 | A1 | 7/2013 |
| WO | 2014118456 | A1 | 8/2014 |
| WO | 2017098932 | A1 | 6/2017 |

OTHER PUBLICATIONS

Written Opinion dated Dec. 19, 2019, issued in corresponding International Application No. PCT/FR2019/051823, filed Jul. 23, 2019, 5 pages.

* cited by examiner

TURBINE BLADE

FIELD OF THE INVENTION

The present invention relates to a turbine blade for a turbomachine, such as for example an aircraft turboengine.

BACKGROUND OF THE INVENTION

Document FR 2 970 999 on behalf of the Claimant discloses a turbine blade wheel comprising a turbine disc on which blades 1 are arranged. Each blade 1 extends radially and has a radially inner foot 2, mounted in a recess in the disc, a profiled vane 3, separated from foot 2 by a radially inner platform 4. A radially outer platform 5 extends from the radially outer end of vane 3. The radially outer platform 5 has radially outwardly extending seal lips 6 which cooperate with abradable material to form a labyrinth seal.

The outer platform 5 has an axially upstream end 7 and an axially downstream end 8 located upstream and downstream, respectively, of the leading edge 9 and trailing edge 10 of vane 3.

In order to lighten the blades 1, it is envisaged to remove part of the radially outer platform 5 by forming openings at the level of said outer platform 5. However, in such a case, part of the air flow may be diverted from the lower deck area 11 to the upper deck area 12 by passing radially outside vane 3 through the openings. Such recirculation is detrimental to the efficiency of the turbine and should therefore be limited.

SUMMARY OF THE INVENTION

The aim of the invention is to offer a simple, efficient and economic solution to this problem.

For this purpose, the invention relates to a turbine blade for a turbomachine intended to extend around an axis of the turbomachine, the blade comprising a vane extending radially with respect to the axis between a radially inner platform and a radially outer platform, the vane comprising an axially upstream leading edge and an axially downstream trailing edge, a radially outer platform comprising an upstream end and a downstream end, the radially outer platform comprising at least one seal lip extending radially outwards, characterised in that the radially outer end of the leading edge of the vane and/or the trailing edge of the vane extending axially upstream relative to the upstream end of the platform and/or respectively downstream relative to the downstream end of the platform, and in that the blade has at least one partition extending radially outwards from the radially outer end of the vane, and axially between the leading edge and the upstream end of the platform, and/or respectively between the trailing edge and the downstream end of the platform.

The retraction of the upstream and/or downstream ends from the leading and/or trailing edge allows to limit the axial dimension of the outer platform and thus the mass of the blade.

Furthermore, the presence of a partition, extending radially outwards and extending axially, i.e. along the turbine axis, between the leading edge of the blade and the upstream end of the platform and/or respectively between the trailing edge and the downstream end of the platform, constitutes at least in part an obstacle to air recirculation. As these recirculations generate aerodynamic losses, such partitions also make it possible to improve the turbine's efficiency.

The partition may extend axially between the leading edge and an upstream surface of the seal lip and/or between the trailing edge and a downstream surface of the seal lip, respectively.

Such a partition prevents any recirculation of air radially outside the outer platform.

According to another feature, the partition may extend radially outward substantially to the radially outer end of the seal lip.

Thus, the partition avoids air recirculation along the entire length of the seal lip, which, in cooperation with the abradable material, ensures the sealing of an air passage.

In addition, the partition may extend radially outward for only a portion of the radial dimension of the seal lip.

Thus, the presence of the partition opposing air recirculation, limiting its radial dimension to only a part of the radial dimension of the seal lip allows to control the addition of matter, and thus to control the mass of the blade.

The radial distance between the radially outer end of the partition and the radially outer end of the seal lip is, for example, between 1 and 10 mm.

The partition may extend in a direction at an angle to the radial direction.

Such an inclination of the partition improves the position of the partition so that it opposes the direction of air recirculation from the lower surface to the upper surface.

The angle is, for example, between 30° and 60°.

According to another characteristic, the partition may have an upstream and/or downstream end edge which is straight and at an angle to the radial direction.

Such an inclination makes it possible to reduce the volume of the partition, and thus to control the mass of the material added to the turbine blade.

The angle is for example between 0° and 60°.

In addition, the seal lip may extend in one plane, with at least a portion of the partition extending perpendicular to the plane of the seal lip.

Consequently, the partition extends partly perpendicular to the seal lip.

In particular, the seal lip may extend in one plane, with at least part of the partition extending in a plane at an angle to the axis of the turbomachine.

The axis of the turbomachine corresponds to the axis of the rotor to which the blades are attached.

The partition is thus inclined in the direction of blade rotation to form a deflector for the air flow. Such a position effectively limits the recirculation of air from the lowerxxx to the upper surface.

Said angle is, for example, between 30° and 60°.

According to another characteristic, the partition can be curved, e.g. concave when viewed from the lower surface of the vane.

The invention also relates to a turbomachine turbine having a bladed wheel comprising turbine blades as described above.

The invention also concerns a turbomachine, such as an aircraft turbojet engine, characterised in that it comprises such a turbine.

The invention will be better understood and further details, characteristics and advantages of the invention will appear when reading the following description given as a non-limiting example in reference to the attached drawings.

DETAILED DESCRIPTION

Hereunder, the terms "upstream" and "downstream" are defined in relation to the direction of gas flow in the turbomachine, particularly in the secondary flow path. Also, les terms "radial" and "axial" are defined in relation to the axis of the turbine wheel. Each turbine blade extends radially outwards from the turbine wheel disc, whose axis of rotation extends axially.

Figure 1:
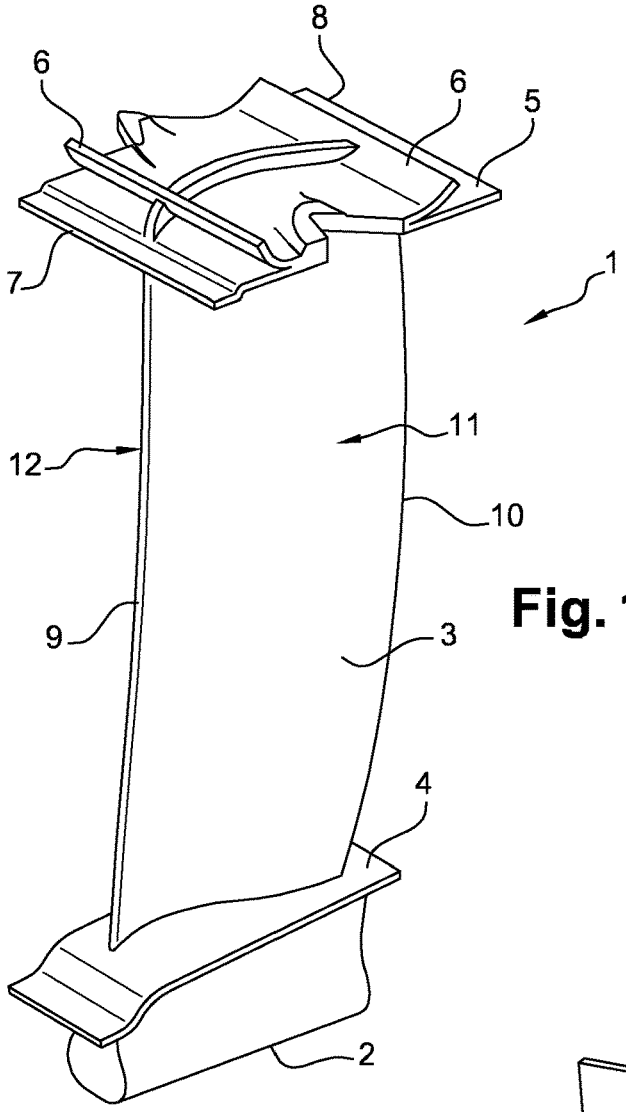
FIG. 1 is a schematic view of a turbine blade according to the prior art.
Figure 2:
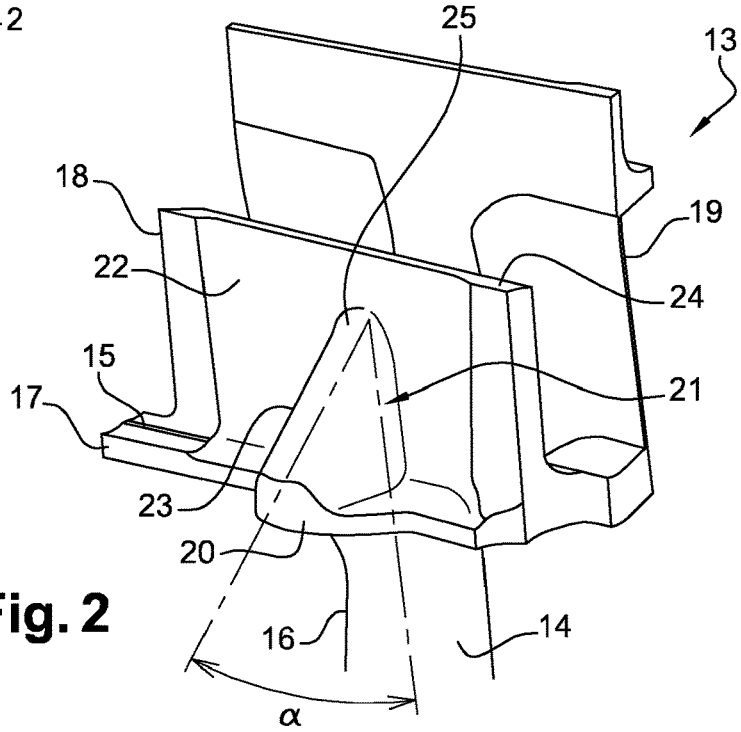
FIG. 2 is a schematic view of an example of turbine blade platform according to an embodiment of the invention.

Reference is made below to FIG. 2 and following in relation to the invention, FIG. 1, concerning the prior art, having already been described above.

FIG. 2 shows a part of a turbine blade 13 for a turbomachine according to the invention. A plurality of turbine blades 13 according to the invention are intended to be mounted on a disc so as to form a turbine wheel.

Blade 13 comprises a radially extending vane 14, and a radially outer platform 15 located at the radially outer end of vane 14. Vane 14 has an axially upstream leading edge 16 and an axially downstream trailing edge (not shown). Platform 15 has an upstream end 17 and a downstream end (not shown). Said platform 15 also has seal lips, namely an upstream seal lip 18 and a downstream seal lip 19 in the example shown in the figures.

In the illustrated example, platform 15 extends axially between the two seal lips 18, 19 and is openworked in relation to platform 5 of the prior art presented above. Platform 15 does not include a section extending axially beyond seal lips 18, 19.

An openwork platform with a part extending beyond the seal lips can also be considered.

In both cases, the radially outer end 20 of the leading edge 16 of vane 14 extends axially upstream from the upstream end 17 of platform 15. Similarly, the radially outer end of the trailing edge (not shown) of vane 14 extends axially downstream relative to the downstream end of platform 15.

The blade 13 according to the invention also has a partition 21. Partition 21 is located radially outside of the radially outer end 20 of the leading edge 16 and/or trailing edge (not shown) of the vane. Indeed, partition 21 extends circumferentially opposite the radially outer end 20 of vane 14.

In addition, partition 21 extends axially between the leading edge 16 and the upstream end 17 of platform 5, and/or respectively between the trailing edge and the downstream end of platform 15.

Partition 21 shown extends axially between the leading edge 16 and an upstream surface 22 of seal lip 18. Similarly, it is conceivable that partition 21 could extend axially between the trailing edge and a downstream surface of the seal lip.

In the embodiment illustrated in FIG. 2, partition 21 extends over only part of the height, i.e. the radial dimension, of the seal lip 18, 19 concerned.

Partition 21 has a straight end edge 23 forming an angle "a" with the radial direction or radial plane. The angle "a" is, for example, between 30° and 90°. The angle "a" lies in a plane normal to the axial direction.

Several embodiment variants are shown in FIGS. 3A to 4B.

The geometric shape and positioning of partitions 21 can vary depending on the application.

Figure 3A:
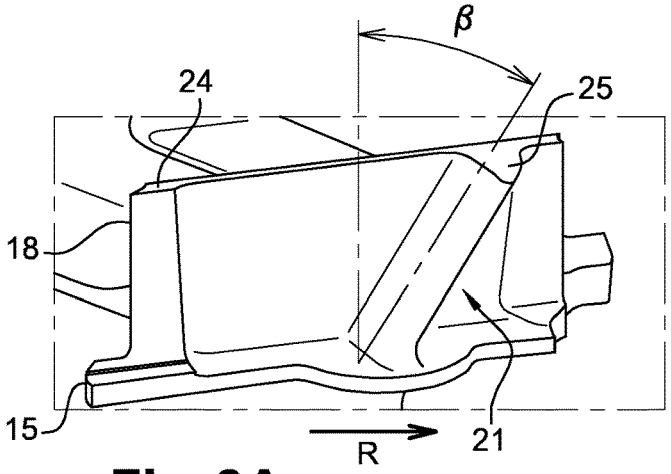
FIGS. 3A to 4B are perspective views illustrating part of a blade in different variants of the invention.
Figure 4A:
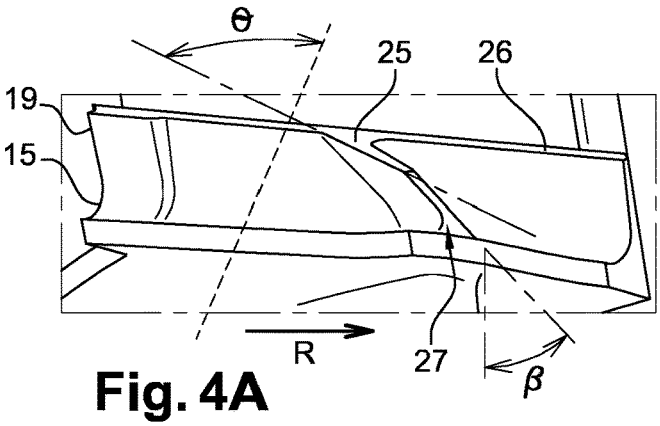

In the embodiment variants shown in FIGS. 3A and 4A, the partition 21, 27, extends radially outwards substantially to the radially outer end 24, 26 of seal lip 18, 19. In other words, partition 21, 27 is approximately the same height as seal lip 18, 19.

Preferably, there is a radial operating clearance between the radially outer end 25 of partition 21, 27 and the radially outer end 24, 26 of seal lip 18, 19. This operating clearance is for example between 0.5 and 2 mm.

Such a clearance thus prevents any friction of partition 21, 27 on the abradable material.

Figure 3B:
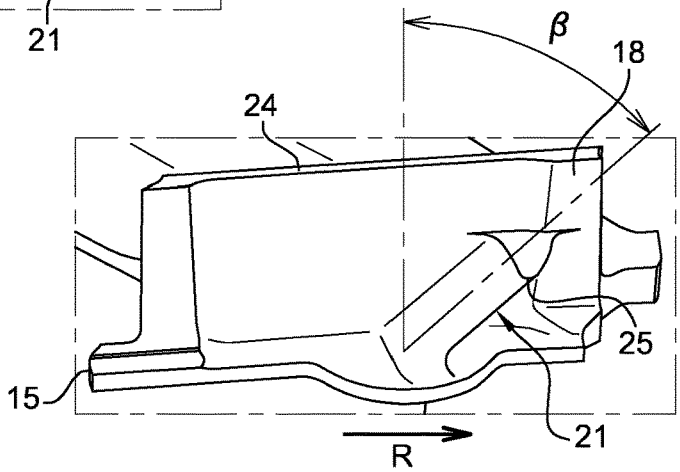
Figure 4B:
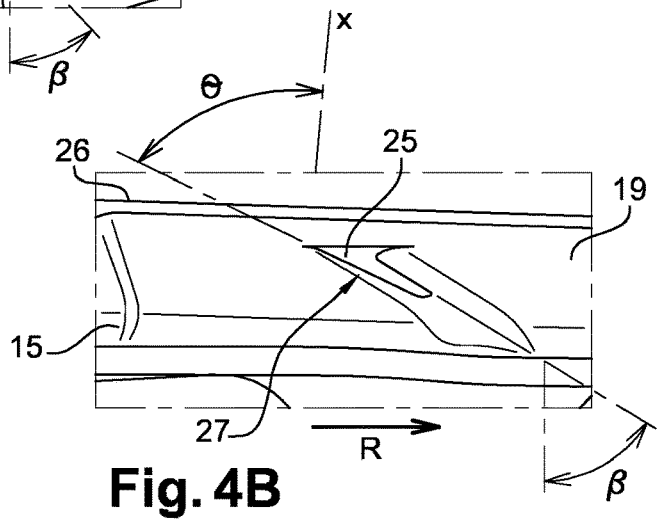

In the embodiment variants shown in FIGS. 3B and 4B, partition 21, 27, extends radially outward over only part of the radial dimension of seal lip 18, 19.

In other words, the radially outer end 25 of partition 21, 27 is offset radially inward from the radially outer end 24, 26 of seal lip 18, 19.

The radial distance between the radially outer end 25 of partition 21, 27 and the radially outer end 24, 26 of seal lip 18, 19 is for example between 0.5 mm and 2 mm.

As shown in FIGS. 3A to 4B, partition 21 at upstream seal lip 18 and partition 27 at downstream seal lip 19 may extend in a direction at an angle (3) to the radial direction.

The angle (3) is, for example, between 0° and 60°.

The angle (3) is inscribed in a plane comprising the axial and radial directions.

Note that, in the embodiment variants of FIGS. 3A to 4B, the angle "a" is equal to 0.

In each alternative construction of FIGS. 3A and 3B, the upstream partition 21 is perpendicular to the plane of the upstream seal lip 18.

Furthermore, in each embodiment variant of FIGS. 4A and 4B, the downstream partition 27 extends, at least in part, in a plane forming an angle of 0 with the X axis of the turbomachine. Thus, the partition and seal lip each extend radially from the blade platform. In particular, the downstream partition 27 is inclined in the direction of the blade rotation direction R so as to form a deflector for the air flow.

In other words, downstream partition 27 is inclined towards the lower surface. The inclination towards the lower surface is particularly interesting because it makes it more difficult to recirculate air from the lower surface to the upper surface area.

Said angle 0 is for example between 0° and 60°.

In each of the embodiments described above, partition 21, 27 constitutes an obstacle to air recirculation from the lower to upper surface area and thus reduces the losses associated with such recirculation. This increases turbine performance, while limiting the weight of the blade 14 due to the limited dimensions of the outer platform 15.

The invention claimed is:

1. A turbine blade for a turbomachine configured to extend around an axis of the turbomachine, the blade having a vane extending radially with respect to the axis between a radially inner platform and a radially outer platform, the vane comprising an axially upstream leading edge and an axially downstream trailing edge, the radially outer platform comprising an upstream end and a downstream end, the radially outer platform comprising at least one radially outwardly extending seal lip wherein at least one of the radially outer end of the leading edge of the vane and the trailing edge of the vane extends one of axially (a) upstream relative to the upstream end of the platform and (b) downstream relative to the downstream end of the platform the blade having at least one partition extending radially outward from the radially outer end of the vane, and at least one of (a) axially between the leading edge and the upstream end of the platform and (b) between the trailing edge and the downstream end of the platform.

2. The turbine blade according to claim 1, wherein the partition extends axially between one of (a) the leading edge and an upstream surface of the seal lip respectively and (b) the trailing edge and a downstream surface of the seal lip.

3. The turbine blade according to claim 2, wherein the partition extends radially outwardly to the radially outer end of the seal lip.

4. The turbine blade according to claim 2, wherein the partition extends radially outwardly over only part of a radial dimension of the seal lip.

5. The turbine blade according to claim 1, wherein the partition extends in a direction at an angle to the radial direction.

6. The turbine blade according to claim 1, wherein the partition has at least one of an upstream end and a downstream end edge which is straight and forms an angle with the radial direction, the angle lying in a plane normal to the axial direction.

7. The turbine blade according to claim 1, wherein the seal lip extends in a plane, at least part of the partition extending perpendicularly to the plane of the seal lip.

8. The turbine blade according to claim 1, wherein the seal lip extends in a plane, at least part of the partition extending in a plane forming an angle with the axis of the turbomachine.

9. The turbine blade according to claim 1, wherein the partition is curved.

10. The turbine for a turbomachine, comprising a bladed wheel having turbine blades according to claim 1.

11. The turbine blade according to claim 9, wherein the partition is concave as seen from the lower surface of the vane.

* * * * *